US006720931B1

(12) United States Patent
Michisaka et al.

(10) Patent No.: US 6,720,931 B1
(45) Date of Patent: Apr. 13, 2004

(54) PLANAR ANTENNA FOR BEAM SCANNING

(75) Inventors: Takao Michisaka, Ibaraki-ken (JP); Masahiko Ohta, Tochigi-ken (JP); Hisayoshi Mizugaki, Ibaraki-ken (JP); Kiichi Kanamaru, Ibaraki-ken (JP)

(73) Assignee: Hitachi Chemical Co., Ltd., Tokyo (JP)

( * ) Notice: Subject to any disclaimer, the term of this patent is extended or adjusted under 35 U.S.C. 154(b) by 0 days.

(21) Appl. No.: 10/257,366

(22) PCT Filed: Apr. 18, 2000

(86) PCT No.: PCT/JP00/02528

§ 371 (c)(1),
(2), (4) Date: Oct. 16, 2002

(87) PCT Pub. No.: WO01/80357

PCT Pub. Date: Oct. 25, 2001

(51) Int. Cl.[7] ..... H01Q 19/06

(52) U.S. Cl. ..... 343/754; 343/700 MS; 343/770; 343/771; 343/909; 343/757

(58) Field of Search ..... 343/700 MS, 753, 343/754, 757, 767, 770, 771, 850, 853, 911 R, 911 L, 909

(56) References Cited

U.S. PATENT DOCUMENTS 3,761,936 A * 9/1973 Archer et al. ..... 343/754
4,899,164 A * 2/1990 McGrath ..... 343/754
6,049,311 A * 4/2000 Alexanian ..... 343/771
6,130,653 A * 10/2000 Powers, Jr. et al. ..... 343/911 R

FOREIGN PATENT DOCUMENTS

| | | | |
|---|---|---|---|
| JP | 5-29832 | 2/1993 | ..... H01Q/21/24 |
| JP | 11-27033 | 1/1999 | ..... H01Q/13/10 |
| JP | 2000-124727 | 4/2000 | ..... H01Q/3/44 |

OTHER PUBLICATIONS

English Language Abstract of JP 2000–124727.
English Language Abstract of JP 11–27033.
English Language Abstract of JP 5–29832.

* cited by examiner

*Primary Examiner*—Hoang V. Nguyen
(74) *Attorney, Agent, or Firm*—Greenblum & Bernstein, P.L.C.

(57) ABSTRACT

A beam scanning plane antenna is formed by stacking, in order, a system connecting portion, a Rotman lens portion, and a beam scanning antenna portion. The system connecting portion is formed by stacking, in order, a fourth grounding conductor, a sixth dielectric, a connecting substrate and a fifth dielectric. The Rotman lens portion is formed by stacking, in order, a third grounding conductor, a fourth dielectric, a Rotman lens substrate and a third dielectric. The beam scanning antenna portion is formed by stacking, in order, a second grounding conductor, a second dielectric, a power feeding substrate, a first dielectric and a first grounding conductor. A plurality of antenna groups that each include an irradiating element, a power feeding line and a first connecting portion, are formed on the power feeding substrate. The Rotman lens substrate includes a Rotman lens pattern, a second connecting portion and a third connecting portion.

6 Claims, 3 Drawing Sheets

PLANAR ANTENNA FOR BEAM SCANNING

TECHNICAL FIELD

The present invention relates to a beam scanning plane antenna used for performing transmission/reception in micro wave band or millimetric wave band.

BACKGROUND ART

The beam scanning antenna, which irradiates with electric waves in all directions of a specific range by changing the angle of the irradiation direction with time passage, often uses Rotman lens as a lens for converting signals from its system to scanning electric waves. As shown in FIG. 1A, this Rotman lens has a micro strip structure comprising a power feeding substrate 6 on which connecting lines 10 for connecting with the system, and power feeding lines 4 are formed; and a grounding conductor 3 attached on the rear face thereof. The power feeding lines 4 are connected to irradiating elements 5 through coaxial lines 15 connected to connectors.

To reduce the quantity of components or the size thereof, as shown in FIG. 1B, it is permissible to have a construction which connects the power feeding lines 4 with the irradiating elements 5 electromagnetically.

In case of the antenna shown in FIG. 1A, the number of the coaxial lines 15 increases depending on the number of the irradiating elements 5 and soldering is needed to connect the irradiating elements 5 with the coaxial lines 15. Thus, the number of assembly steps is large and it is difficult to form a thin structure because of its stereo structure.

Further, the antenna shown in FIG. 1B uses electromagnetic coupling for connecting the connecting lines 16 extending from the Rotman lens pattern 8 with the irradiating elements 5. In this case, if the distance between the Rotman lens pattern 8 and the irradiating element 5 is short, irradiation directivity may drop. On the other hand, if this distance is prolonged to avoid this phenomenon, the connecting line 16 is prolonged, so that reduction in the size of the power feeding substrate 6 becomes difficult to achieve and further, loss on the connecting line increases.

DISCLOSURE OF INVENTION

An object of the present invention is to provide a small beam scanning plane antenna which is excellent in terms of its thin structure and simplification of its assembly process.

To achieve the above object, the beam scanning plane antenna is formed by stacking a system connecting portion, a Rotman lens portion, and a beam scanning antenna portion in that order. The beam scanning antenna portion includes a power feeding substrate containing a plurality of antenna groups each constituted of an irradiating element, a power feeding line connected to the irradiating element and a first connecting portion connected electromagnetically to the Rotman lens portion; a first grounding conductor having-a first slot at a position corresponding to the position of the irradiating element; a second grounding conductor having a second slot at a position corresponding to the position of the first connecting portion; a first dielectric provided between the first grounding conductor and the power feeding substrate; and a second dielectric provided between the power feeding substrate and the second grounding conductor. The Rotman lens portion includes a Rotman lens substrate having a Rotman lens pattern, a second connecting portion, which is connected to the Rotman lens pattern, for connecting the Rotman lens pattern with the first connecting portion, and a third connecting portion, which is connected to the Rotman lens pattern, for connecting the Rotman lens pattern with the system connecting portion electromagnetically; a third grounding conductor having a third slot at a position corresponding to the position of the third connecting portion; a third dielectric provided between the second grounding conductor and the Rotman lens substrate; and a fourth dielectric provided between the Rotman lens substrate and the third connecting conductor. The Rotman lens portion and the beam scanning antenna portion are formed by stacking the third grounding conductor, the fourth dielectric, the Rotman lens substrate, the third dielectric, the second grounding conductor, the second dielectric, the power feeding substrate, the first dielectric and the first grounding conductor in that order.

According to the invention the system connecting portion comprises: a connecting substrate including a fourth connecting portion provided at a position corresponding to the position of the third connecting portion on the Rotman lens substrate and a connecting line for connecting at least the fourth connecting portion with the system; a fourth grounding conductor provided at least at a position corresponding to the position of the fourth connecting portion; a fifth dielectric provided between the third grounding conductor and the connecting substrate; and a sixth dielectric provided between the connecting substrate and the fourth grounding conductor, wherein the fifth dielectric, the connecting substrate, the sixth dielectric and the fourth grounding conductor are stacked in order.

According to the invention a plurality of antenna groups on the power feeding substrate, the Rotman lens pattern on the Rotman lens substrate, the second connecting portions, the third connecting portion, the fourth connecting portions and the connecting lines are formed by removing unnecessary copper foil by etching from copper coated lamination film in which copper foil is bonded to polyimide film as a foundation material.

According to the invention a foamed body having a relative dielectric constant of 1.1 is used for the first dielectric, the second dielectric, the third dielectric, the fourth dielectric, the fifth dielectric and the sixth dielectric.

According to the invention the first slot is a square whose one side is 0.59 times longer than free wavelength $\lambda_0$.

According to the invention an aluminum plate is used for the first grounding conductor, the second grounding conductor, the third grounding conductor and the fourth grounding conductor.

BEST MODE OR CARRYING OUT THE INVENTION

Figure 1A:
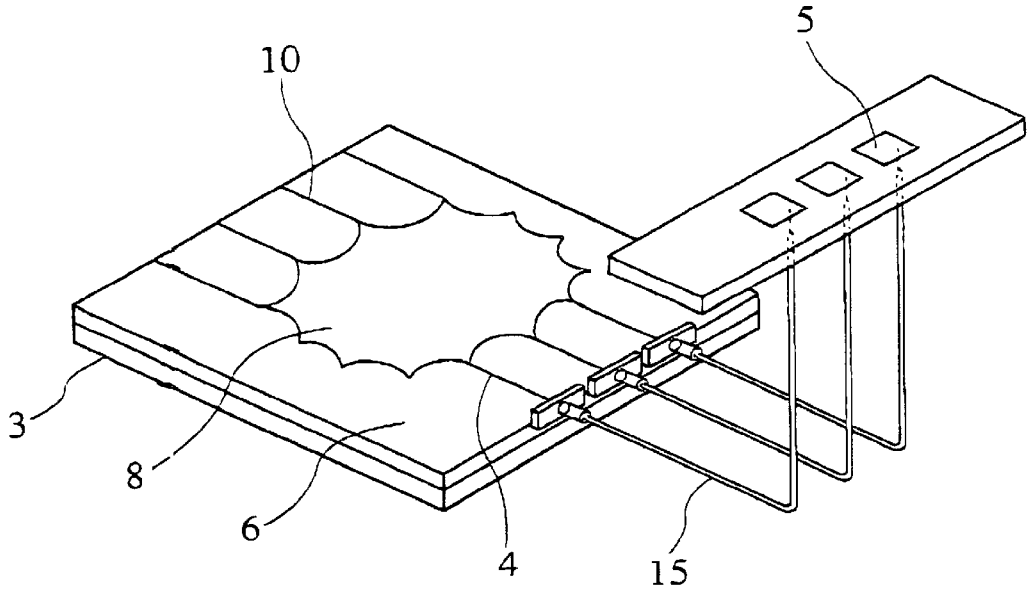
FIG. 1A PRIOR ART
FIG. 1A and FIG. 1B are disassembly perspective diagrams showing a conventional example.
Figure 1B:
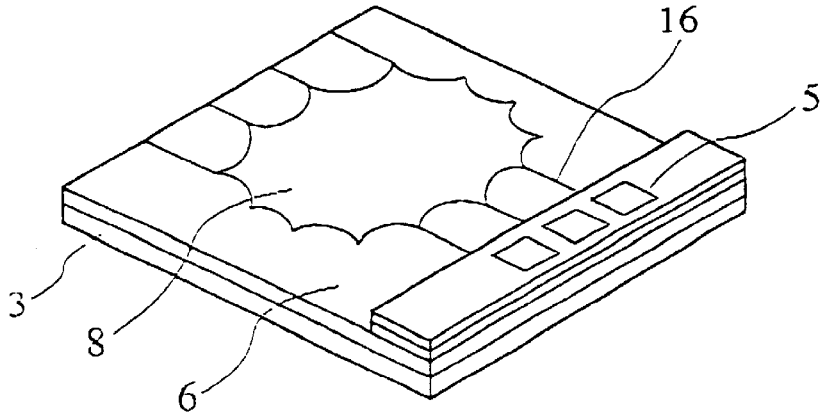
FIG. 1B PRIOR ART

According to the present invention, a plurality of antenna groups are formed on a power feeding substrate 61 by removing unnecessary copper foil by etching from a copper coated lamination film in which copper foil is attached on a polyimide film as its foundation material thereof. Each antenna group comprises an irradiating element 50, a power feeding line 40 connected thereto and a first connecting portion 51 connected electromagnetically to a Rotman lens portion 103. Instead of the copper coated lamination film, it is permissible to use a flexible substrate in which aluminum foil is bonded to a polyethylene terephthalate film.

Likewise, a ROTOAMAN lens substrate 62 and a connecting substrate 63 can be produced.

As a first grounding conductor 11, any metallic plate or any plated plastic plate may be used. Particularly, if the aluminum plate is used, preferably it can be manufactured with light weight and at a cheap price.

A second grounding conductor 12, a third grounding conductor 13, and a fourth grounding conductor 14 may be manufactured in the same manner.

As a first dielectric 31, a second dielectric 32, a third dielectric 33, a fourth dielectric 34, a fifth dielectric 35 and a sixth dielectric 36, preferably, air or a foamed body having a low relative dielectric constant is used.

EXAMPLE

Figure 2:
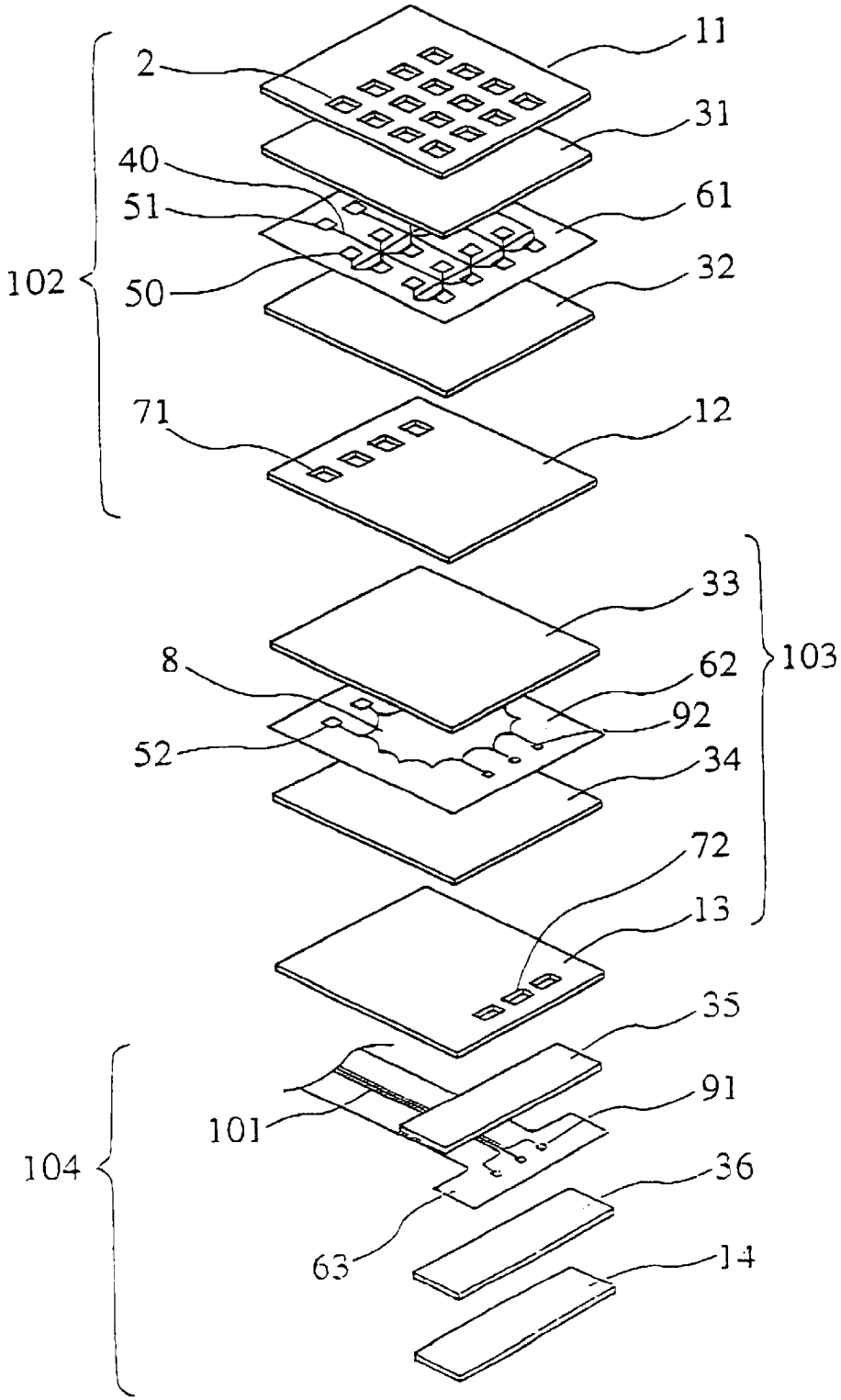
FIG. 2 is a disassembly perspective diagram showing an embodiment of the present invention.

As shown in FIG. 2, the beam scanning plane antenna according to an embodiment of the present invention is formed by stacking a beam scan antenna portion 102, a Rotman lens portion 103 and a system connecting portion 104 in order from top.

As shown in FIG. 2, the beam scanning antenna portion 102 is formed by stacking the first grounding conductor 11, the first dielectric 31, the power feeding substrate 61, the second dielectric 32 and the second grounding conductor 12 in order from top.

A plurality of antenna groups are formed on the power feeding substrate 61 by removing unnecessary copper foil from copper coated lamination film in which copper foil having the thickness of 35 $\mu$m is bonded on polyimide film having the thickness of 25 $\mu$m as its foundation material. Each antenna group is constituted of an irradiating element 50, a power feeding line 40 connected thereto and a first connecting portion 51 connected electromagnetically to the Rotman lens portion 103.

As the first grounding conductor 11, an aluminum plate 0.6 mm thick is used. First slots 2, each is a square whose one side is 0.59 times longer than free space wavelength $\lambda_0$ are provided at positions of the first grounding conductor 11 corresponding to the positions of irradiating elements 50. The interval for the arrangement of the first slots 2 is 0.90 times longer than the free space wavelength $\lambda_0$.

As the second grounding conductor 12, an aluminum plate 0.6 mm thick is used. Second slots 71 are provided at, positions of the second grounding conductor 12 corresponding to the positions of the first connecting portions 51.

As the first dielectric 31 and the second dielectric 32, a foamed body 0.3 mm thick having a relative dielectric constant of 1.1 is used.

Further, as shown in FIG. 2, the Rotman lens portion 103 is formed by stacking the third dielectric 33, the Rotman lens substrate 62, the fourth dielectric 34, and the third grounding conductor 13 in order from top.

A Rotman lens pattern 8, a second connecting portion 52 and a third connecting portion 92 are formed on the Rotman lens substrate 62 by removing unnecessary copper foil by etching from copper coated lamination film in which copper foil 35 $\mu$m thick is bonded on polyimide film 25 $\mu$m thick as its foundation material. The second connecting portion 52 is connected to the ROTOAMAN lens pattern 8 thereby connecting the ROROMAN lens pattern 8 with the first connecting portion 51. The third connecting portion 92 is connected to the Rotman lens pattern 8, thereby connecting the Rotman lens pattern 8 with the system connecting portion 104 electromagnetically.

As the third connecting conductor 13, an aluminum plate 3 mm thick is used. Third slots 72 are provided at positions of the third grounding conductor 13 corresponding to the positions of the third connecting portions 92.

As the third dielectric 33 and the fourth dielectric 34, a foamed body 0.3 mm thick having a relative dielectric constant of 1.1 is used.

As shown in FIG. 2, the system connecting portion 104 is formed by stacking the fourth dielectric 35, the connecting substrate 63, the fifth dielectric 36 and the fourth grounding conductor 14 in order from top.

The fourth connecting portions 91 and the connecting lines 101 are formed on the connecting substrate 63 by removing unnecessary copper foil by etching from copper coated lamination film in which copper foil 35 $\mu$m is bonded on polyimide film 25 $\mu$m thick as a foundation material. The fourth connecting portions 91 are provided at positions of the ROTOAMAN lens substrate 62 corresponding to the positions of the third connecting portions 92. The connecting lines 101 connect at least the fourth connecting portions 91 with the system.

The fourth grounding conductor 14 is provided at least at a position corresponding to the fourth connecting portion 91. As the fourth grounding conductor 14, an aluminum plate 3 mm thick is used.

As the fifth dielectrics 35 and the sixth dielectric 36, a foamed body 0.3 mm thick having a relative dielectric constant of 1.1 is used.

The beam scanning plane antenna according to the embodiment of the present -invention is constructed as described above. In other words, this beam scanning plane antenna is formed by stacking the system connecting portion 104, the Rotman lens portion 103 and the beam scanning antenna portion 102 in order from bottom. If speaking more in detail, this beam scanning plane antenna is formed by stacking the fourth grounding conductor 14, the sixth dielectric body 36, the connecting substrate 63, the fifth dielectric body 35, the third grounding conductor 13, the fourth dielectric body 34, the Rotman lens substrate 62, the third dielectric 33, the second grounding conductor 12, the second dielectric 32, the power feeding substrate 61, the first dielectric body 31 and the first grounding conductor 11 in order from bottom.

Figure 3A:
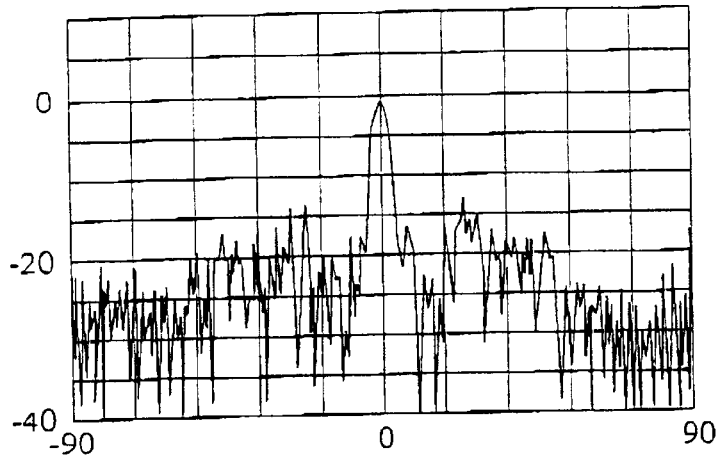
FIG. 3A is a diagram showing the directivity characteristic when beam is projected in the perpendicular direction.
Figure 3B:
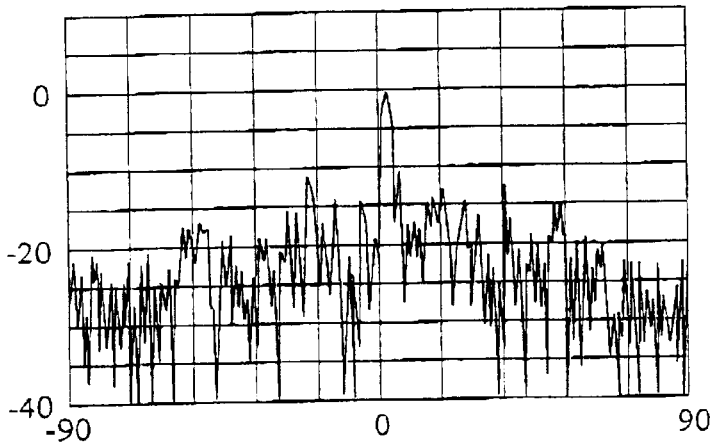
FIG. 3B is a diagram showing the directivity characteristic when the beam is inclined two degrees from the perpendicular direction.
Figure 3C:
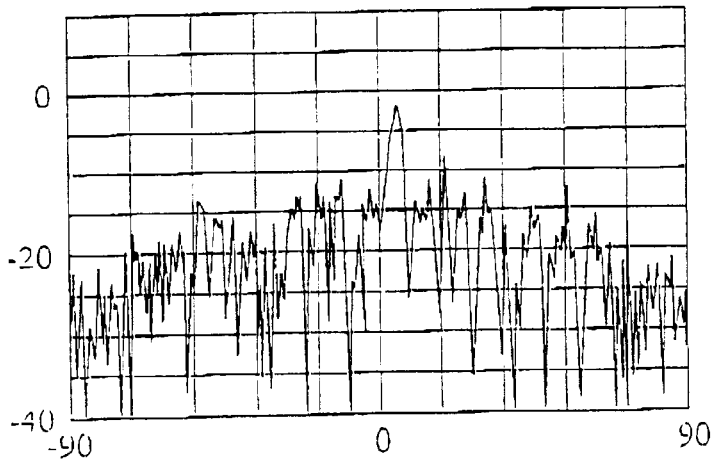
FIG. 3C is a diagram showing directivity characteristic when the beam is inclined four degrees from the perpendicular direction.

Consequently, the antenna having the directivity shown in FIGS. 3A to 3C is constructed. FIG. 3A shows the directivity characteristic when beam is projected in the perpendicular direction. FIG. 3B is a diagram showing the directivity characteristic when the beam is inclined two degrees from the perpendicular direction. FIG. 3C is a diagram showing directivity characteristic when the beam is inclined four degrees from the perpendicular direction.

INDUSTRIAL APPLICABILITY

As described above, the present invention is capable of providing a small beam scanning plane antenna which is excellent in terms of its thin, structure and simplification of its assembly process.

What is claim is:

1. A beam scanning plane antenna configured by stacking, in order, a system connecting portion, a Rotman lens portion, and a beam scanning antenna portion, the beam scanning antenna portion including:

a power feeding substrate containing a plurality of antenna groups that each include an irradiating element, a power feeding line connected to the irradiating element, and a first connecting portion connected electromagnetically to the Rotman lens portion;

a first grounding conductor having a first slot at a position corresponding to the position of the irradiating element;

a second grounding conductor having a second slot at a position corresponding to the position of the first connecting portion;

a first dielectric provided between the first grounding conductor and the power feeding substrate; and a second dielectric provided between the power feeding substrate and the second grounding conductor, the Rotman lens portion including:

a Rotman lens substrate having a Rotman lens pattern, a second connecting portion, which is connected to the Rotman lens pattern, for connecting the Rotman lens pattern with the first connecting portion, and a third connecting portion, which is connected to the Rotman lens pattern, for connecting the Rotman lens pattern with the system connecting portion electromagnetically;

a third grounding conductor having a third slot at a position corresponding to the position of the third connecting portion;

a third dielectric provided between the second grounding conductor and the Rotman lens substrate; and a fourth dielectric provided between the Rotman lens substrate and the third connecting conductor, wherein the Rotman lens portion and the beam scanning antenna portion are configured by stacking, in order, the third grounding conductor, the fourth dielectric, the Rotman lens substrate, the third dielectric, the second grounding conductor, the second dielectric, the power feeding substrate, the first dielectric and the first grounding conductor.

2. The beam scanning plane antenna according to claim 1 wherein the system connecting portion comprises:

a connecting substrate including a fourth connecting portion provided at a position corresponding to the position of the third connecting portion on the Rotman lens substrate and a connecting line for connecting at least the fourth connecting portion with the system;

a fourth grounding conductor provided at least at a position corresponding to the position of the fourth connecting portion;

a fifth dielectric provided between the third grounding conductor and the connecting substrate; and a sixth dielectric provided between the connecting substrate and the fourth grounding conductor, wherein the fifth dielectric, the connecting substrate, the sixth dielectric and the fourth grounding conductor are stacked in order.

3. The beam scanning plane antenna according to claim 2 wherein a plurality of antenna groups on the power feeding substrate, the Rotman lens pattern on the Rotman lens substrate, the second connecting portions, the third connecting portion, the fourth connecting portions and the connecting lines are formed by removing unnecessary copper foil by etching from copper coated lamination film in which copper foil is bonded to polyimide film as a foundation material.

4. The beam scanning plane antenna according to claim 2 wherein a foamed body having a relative dielectric constant of 1.1 is used for the first dielectric, the second dielectric, the third dielectric, the fourth dielectric, the fifth dielectric and the sixth dielectric.

5. The beam scanning plane antenna according to claim 1 wherein the first slot is a square whose one side is 0.59 times longer than free space wavelength $\lambda_0$.

6. The beam scanning plane antenna according to claim 2 wherein an aluminum plate is used for the first grounding conductor, the second grounding conductor, the third grounding conductor and the fourth grounding conductor.

* * * * *